US012188684B2

(12) United States Patent
McQueeny, Jr. et al.

(10) Patent No.: US 12,188,684 B2
(45) Date of Patent: Jan. 7, 2025

(54) AIR DELIVERY ASSEMBLIES, METHODS, AND KITS FOR DELIVERING IONS

(71) Applicant: AIRFIXTURE LLC, Kansas City, KS (US)

(72) Inventors: Michael J. McQueeny, Jr., Leawood, KS (US); Matthew Ryan Clark, Kansas City, MO (US); Suwan Cho, Lenexa, KS (US)

(73) Assignee: AIRFIXTURE LLC, Kansas City, KS (US)

( * ) Notice: Subject to any disclaimer, the term of this patent is extended or adjusted under 35 U.S.C. 154(b) by 379 days.

(21) Appl. No.: 17/691,949

(22) Filed: Mar. 10, 2022

(65) Prior Publication Data

US 2023/0288084 A1 Sep. 14, 2023

(51) Int. Cl.
*F24F 8/30* (2021.01)
*F24F 13/20* (2006.01)

(52) U.S. Cl.
CPC ..... *F24F 8/30* (2021.01); *F24F 13/20* (2013.01); *F24F 2221/40* (2013.01)

(58) Field of Classification Search
CPC ..... F24F 2221/40
See application file for complete search history.

(56) References Cited

U.S. PATENT DOCUMENTS

2013/0183214 A1* 7/2013 Metteer ..... F24F 8/20 422/123
2022/0221174 A1* 7/2022 Jette ..... F24F 8/22

* cited by examiner

*Primary Examiner* — Nicole M Ippolito
(74) *Attorney, Agent, or Firm* — SHOOK, HARDY & BACON L.L.P.

(57) ABSTRACT

An air delivery assembly having a baffle and an ionizer. The baffle is constructed to affect air flow such that air flowing through the air delivery assembly has an air velocity and a direct flow to the ionizer that is effective to deliver ions through a diffuser of the air delivery assembly and up into a room. The air delivery assembly may be included with a damper and/or an upper diffuser to form an air terminal, which may be used in a raised floor air distribution system.

20 Claims, 7 Drawing Sheets

AIR DELIVERY ASSEMBLIES, METHODS, AND KITS FOR DELIVERING IONS

CROSS-REFERENCE TO RELATED APPLICATIONS

Not applicable.

STATEMENT REGARDING FEDERALLY SPONSORED RESEARCH OR DEVELOPMENT

Not applicable.

BRIEF SUMMARY OF THE INVENTION

The present invention generally relates to a delivery of ions into rooms with raised floor air distributions systems. More particularly, this invention relates to an air delivery assembly for use in raised floor air distribution systems including an ionizer and a baffle with a construction that affects air flow through the air delivery assembly in a manner that is suitable to deliver ions generated by the ionizer into a room.

Air delivery assemblies affecting airflow to aid in a delivery of air into a room via raised floor air distribution systems are well known in the art. One particular construction known to be beneficial is disclosed in U.S. Patent Application Publication No. 2007/0066213 A1, which is incorporated by reference in its entirety. It discloses an air delivery assembly that is coupled with a damper to create a floor terminal for use in a raised floor air distribution system. A baffle is coupled between a pair of side walls of the air delivery assembly, and the vane of the damper opens and closes a passageway to selectively permit air to pass therethrough from a plenum under the raised floor, into the air delivery system and then up into a room through the floor.

Another particular construction known to be beneficial is disclosed in U.S. Pat. No. 9,127,854 B2, which is incorporated by reference in its entirety. It discloses a damper construction that may be coupled to an air delivery assembly, which may include one or more baffles. The damper controls the flow of air into the air delivery assembly, and the baffle affects the flow of air through the air delivery assembly and out into the room.

As best illustrated in FIG. 2 thereof, the baffle 20 laterally extends through an interior of the air delivery assembly 12, and top and bottom edges of the baffle 20 are respectively spaced apart from the top opening 18 and a bottom wall of the air delivery assembly 12. However, because the baffle has a continuous, solid structure, air flowing through the air delivery assembly may only flow behind the baffle after passing above the baffle's top edge or below the baffle's bottom edge between it and the bottom wall of the air delivery assembly. As such, air flowing behind the baffle has been redirected, and in turn, an air velocity of at least some of the air that flows behind the baffle may be reduced while flowing through the air delivery assembly.

While the air delivery assembly and the baffle are suitable for delivering air into a room in most situations, they are not suitable for delivery of ions. For example, delivering ions into a room requires an addition of a device that generates ions (e.g., an ionizer) and an adapted air flow through the air delivery assembly in which air flows directly to an area where ions are generated at an increased air velocity. As such, the air delivery assembly and the baffle, as well as their effects on air flow, of U.S. Patent Application Publication No. 2007/0066213 A1 and U.S. Pat. No. 9,127,854 B2 are not suitable for delivering ions into a room.

In accordance with aspects herein, known devices and/or techniques may be utilized to generate ions (e.g., negatively and/or positively charged molecules including but not limited to H+ ions, O2+ ions, HO− ions, and O2− ions) for purposes of sanitizing, disinfecting, and/or purifying air in a room. In general, such devices and/or techniques may generate ions from air by transferring energy to air molecules, and as is known in the art, ions have properties that cause them to attach to and then deactivate harmful substances such as airborne mold, bacteria, allergens, viruses, and the like, as well as particles that transport harmful substances such as breath droplets and dust particles. Consequently, ions may be utilized to disinfect air.

However, known devices and/or techniques for generating ions are not capable of dispersing the ions throughout air occupying spatial areas, such as rooms. Moreover, ions may frequently group together to form plasma bubbles, which, for example, may be formed proximate an area where an electrical charge of an ionizer is emanated and imparted to air molecules (e.g., an upper face of the ionizer). Once such a plasma bubble is formed, it typically remains at the area of the ionizer where it was formed, and air flowing indirectly thereto and/or at an insufficient velocity passes around the plasma bubble. As a result, when an ion generator is incorporated into prior art air delivery assemblies and baffles, the ion concentration in the air of a room to which ions are delivered is from about 3 ions per cubic centimeter to about 500 ions per cubic centimeter. As used herein, the term "about" shall mean±10% of a given value. Thus, air delivery assemblies and baffles of known raised floor distribution systems are not suitable for delivering ions into a room at a quantity that is sufficient to disinfect air.

Accordingly, it would be desirable for an air delivery assembly to be capable of delivering ions into a room to disinfect the air of the room, especially during time periods in which the air is more likely to contain harmful substances that may pose health risks (e.g., flu season, allergy seasons, pandemics, and the like). To create such an air delivery assembly, an ionizer (i.e., a device that generates ions by imparting an electrical charge to neutral air molecules) was incorporated into the air delivery assembly and a baffle of the air delivery assembly was constructed to affect air flow such that air flowing through the air delivery assembly has an air velocity and a direct flow to the ionizer that is effective to deliver ions through a diffuser of the air delivery assembly and up into a room.

In more detail, the ionizer is positioned within the air flow chamber and is configured to generate ions proximate an ionization zone (i.e., an area where ions are generated within the air flow chamber). The baffle is coupled between a pair of sidewalls of the chassis and has a construction (e.g., upper wing, lower wing, medial body, and a central opening) that is configured such that air flowing through the air delivery assembly has an air velocity that is increased and/or flows directly to the ionization zone by traveling through a central opening of the baffle.

Further objects, features and advantages of the present invention over the prior art will become apparent from the detailed description of the drawings which follows, when considered with the attached figures.

BRIEF DESCRIPTION OF THE SEVERAL VIEWS OF THE DRAWINGS

The features of the invention noted above are explained in more detail with reference to the embodiment illustrated in the attached drawing figures, in which like reference numerals denote like elements, in which FIGS. 1-7 illustrate possible embodiments of the present invention, and in which:

FIG. 1 is schematic perspective view of a room with a portion of a raised floor cut out to illustratively depict an air terminal that includes an air delivery assembly for delivering ions into the room in accordance with aspects herein;

FIG. 2 is a top right perspective view of an air terminal having an air delivery assembly with a baffle and an ionizer in accordance an embodiment of the present invention;

FIG. 5 is an exploded, top right perspective view of the air terminal of FIG. 2;

FIG. 6 is a top right perspective view of a kit for retrofitting an air terminal of the prior art to deliver ions into a room, the kit including a baffle, an ionizer, a power component, and attachment means; and FIG. 7 is a flow chart depicting steps of a method for delivering ions into a room.

DETAILED DESCRIPTION OF THE INVENTION

Figure 1:
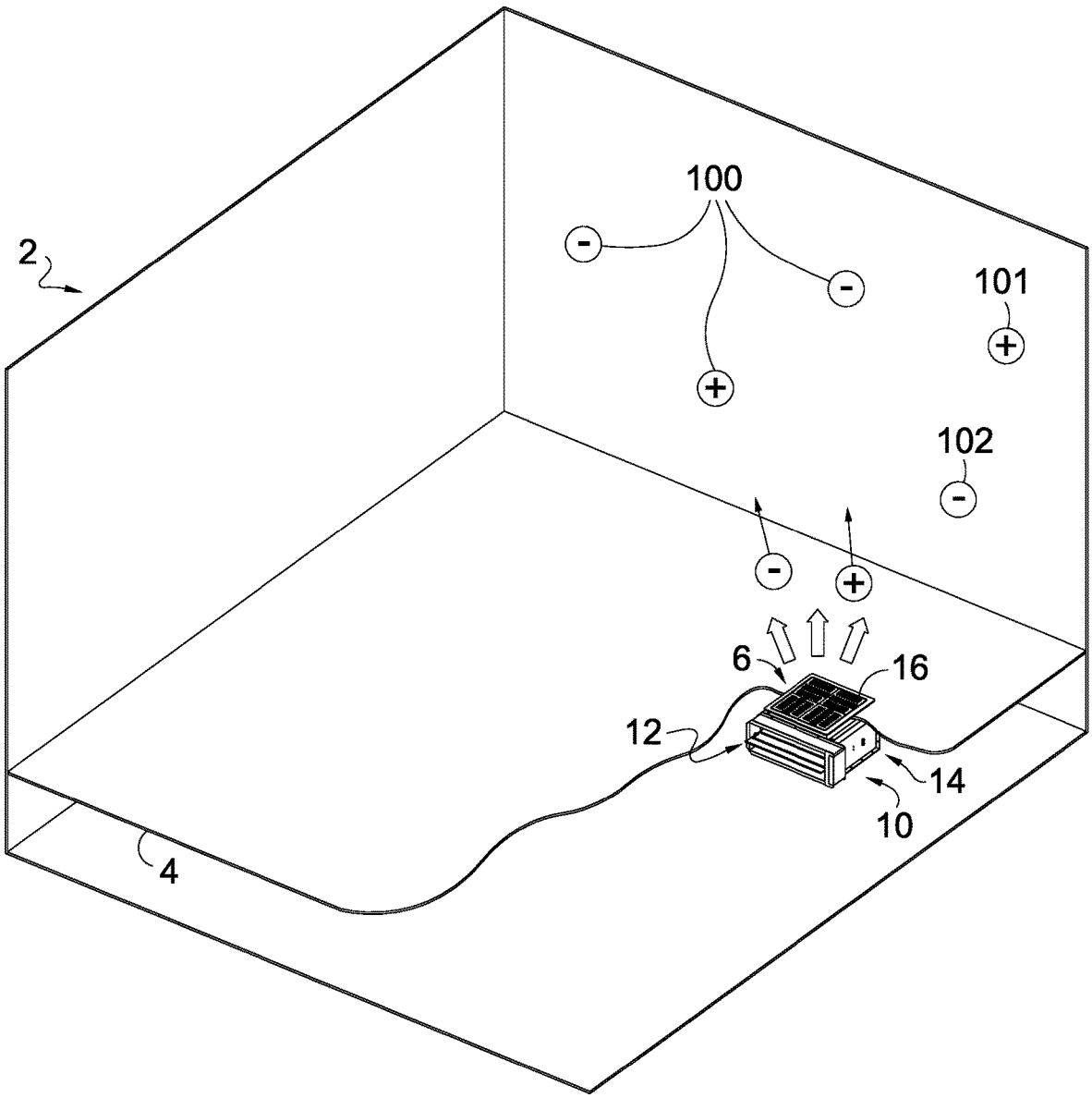

Referring now to the drawings in more detail and initially to FIG. 1, numeral 2 generally designates a room with a raised floor 4, and numeral 10 generally designates an air terminal constructed in accordance with an embodiment of the present invention. The air terminal 10 includes a damper 12 and an air delivery assembly 14, each of which may generally be formed from sheet metal, and an upper diffuser or grille 16, which may be cast from metal or plastic.

FIG. 1 shows the raised floor 4 with a portion removed to illustrate a position of the air terminal 10 in an opening 6 of a raised floor air distribution system. On account of this position, air from a plenum under the raised floor 4 enters the air terminal 10 at the damper 12, travels through the air delivery assembly 14 where it may be further conditioned to include ions, exits the floor terminal 10 at the upper diffuser 16, and then flows up and into the room 2. As discussed in more detail hereinafter, the air delivery assembly 14 is configured such that air flows through the air delivery assembly 14 in a manner that is effective to deliver ions 100 (e.g., ion-conditioned air) through the upper diffuser 16 and up into the room 2.

In FIG. 1 (and also 4B), large arrows illustratively depict air flow, and small arrows depict movement of ions 100. Further, the ions 100 are illustratively depicted in FIG. 1 (and also FIG. 4B) as circles that include either a "+" or a "−" symbol, which represent an electronic charge of a respective ion. For example, numeral 101 designates a positive ion, which includes a "+" symbol, and likewise, numeral 102 designates a negative ion, which includes a "−" symbol. Further, the ions 100 may include two or more positive ions, two or more negative ions, or a combination of one or more positive ions and one or more negative ions. In aspects, when the ions 100 include both positive and negative ions, the ions 100 may collectively be referred to as "bipolar" ions. Notwithstanding, it is to be understood that the term "bipolar" when referring to ions and/or ion-conditioned air is not limiting, and it is contemplated herein that the ions 100 may include a combination of one or more positive ions and one or more negative ions, even when no reference to "bipolar" ions is made.

As understood by those having ordinary skill in the art, an ion is a molecule that comprises a net positive charge or a net negative charge. As such, the ions 100, as well as the positive ion 101 and the negative ion 102, illustratively represent ions that may be formed by altering molecules and/or atoms commonly present in air to have a net positive charge or a net negative charge. Further, it is to be understood that depictions of an individual ion (e.g., one of the ions 100, the positive ion 101, and/or the negative 102) is illustrative only and is not representative of an actual amount or number of ions that may be present. As such, aspects herein contemplate that any of the individual ions depicted in FIGS. 1 and 4B, may represent any amount or number of ions. Such aspects further contemplate that the ions 100 represents a concentration of ions in the air of the room 2 that is about 30,000 ions per cubic centimeter.

Figure 2:
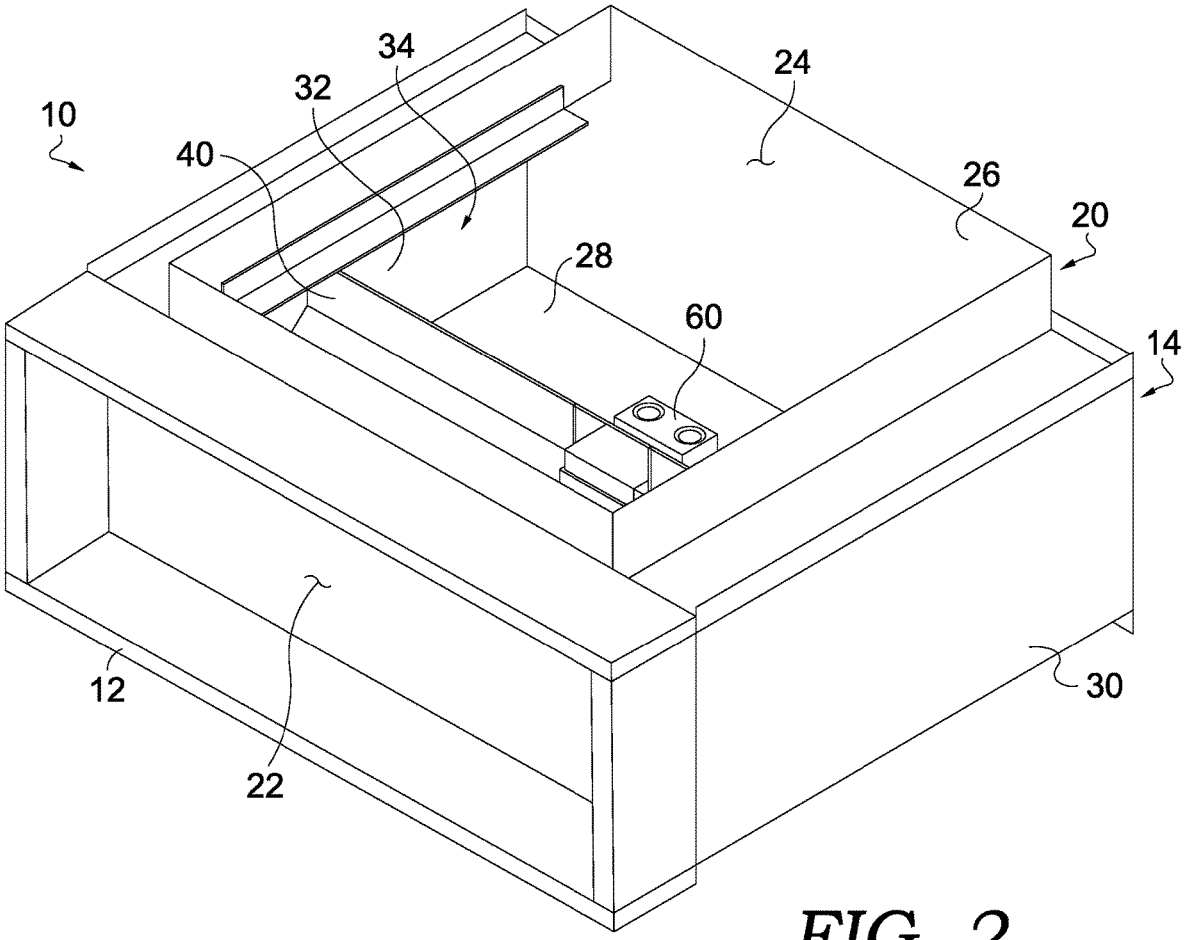

Referring now to FIG. 2, the air terminal 10 is shown without parts of the damper 12 and with the upper diffuser 16 removed to better illustrate aspects of the air delivery assembly 14. As shown in FIG. 2, the air delivery assembly 14 includes a chassis 20, a baffle 40, and an ionizer 60. The chassis 20 generally defines a structure of the air delivery assembly 14 and includes a lateral opening 22, a top opening 24, a back wall 26, a bottom wall 28, a right wall 30, and a left wall 32. The lateral opening 22 is positioned opposite the back wall 26 and is configured for receiving and/or coupling with the damper 12, which may cover the lateral opening 22 and selectively control a flow of air from the under floor 4 plenum into the air delivery assembly 14. Similarly, the top opening 24 is positioned opposite the bottom wall 28 and is configured for receiving and/or coupling with the upper diffuser 16 (not shown in FIG. 2), which may cover the top opening 24 but still allow air to flow therethrough. As such, the back, bottom, right, and left walls 26, 28, 30, 32 cooperate to define an air flow chamber 34 in which air enters through the lateral opening 22, flows through the air delivery assembly 14, and exits through the top opening 24. In an example aspect, the air delivery assembly 14 is configured such that an ion concentration of air in a room to which ions are delivered is equal to or greater than about 1,500 ions per cubic centimeter or is equal to or greater than about 2,500 ions per cubic centimeter. In other example aspects, the air delivery assembly 14 is configured such that an ion concentration of air in a room to which ions are delivered is from about 20,000 ions per cubic centimeter to about 40,000 ions per cubic centimeter, from about 25,000 ions per cubic centimeter from about 35,000 ions per cubic centimeter, or about 30,000 ions per cubic centimeter.

Figure 5:
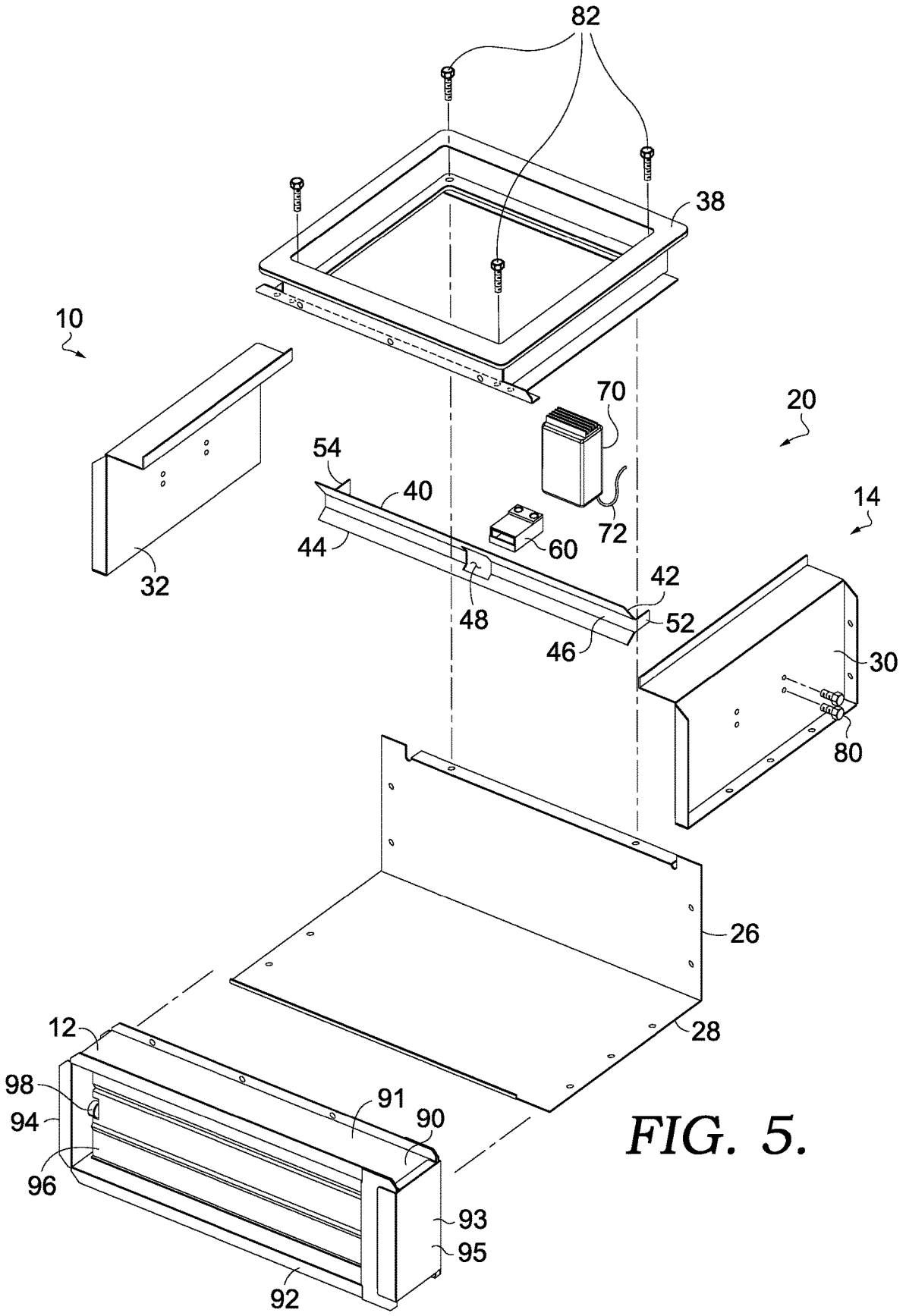

With further reference to FIG. 5, the back and bottom walls 26, 28 are both generally rectangular, and the back wall 26 depends upwardly from a rear portion of the bottom wall 28 such that the back and bottom walls 26, 28 cooperatively form an "L" shape. The back and bottom walls 26, 28 may each include one or more lips, flanges, and/or tabs, any of which may include one or more apertures, that are configured to respectively couple the back and bottom walls 26, 28 with the right wall 30, the left wall 32, other components of the air delivery assembly 14, and/or other components of the air terminal 10 (e.g., the damper 12, the upper diffuser 16). It should be appreciated by one ordinary skill in the art that any suitable coupling method may be used.

The right and left walls 30, 32 are mirror images and may be referred to as a "pair of sidewalls." The right and left walls 30, 32 are both generally rectangular, and in the air delivery assembly 14, the right and lefts walls 30, 32 are spaced apart and generally face one another. The right wall 30 depends upwardly from a right portion of the bottom wall 28, and the left wall 32 depends upwardly from a left portion of the bottom wall 28. The right and left walls 30, 32 may each include one or more lips, flanges, and/or tabs, any of which may include one or more apertures, that are configured to respectively couple the right and left walls 30, 32 with the back wall 26, the bottom wall 28, other components of the air delivery assembly 14, and/or other components of the air terminal 10 (e.g., the damper 12, the upper diffuser 16, the baffle 40). It should be appreciated by one of ordinary skill in the art that any suitable coupling method may be used.

Figure 3A:
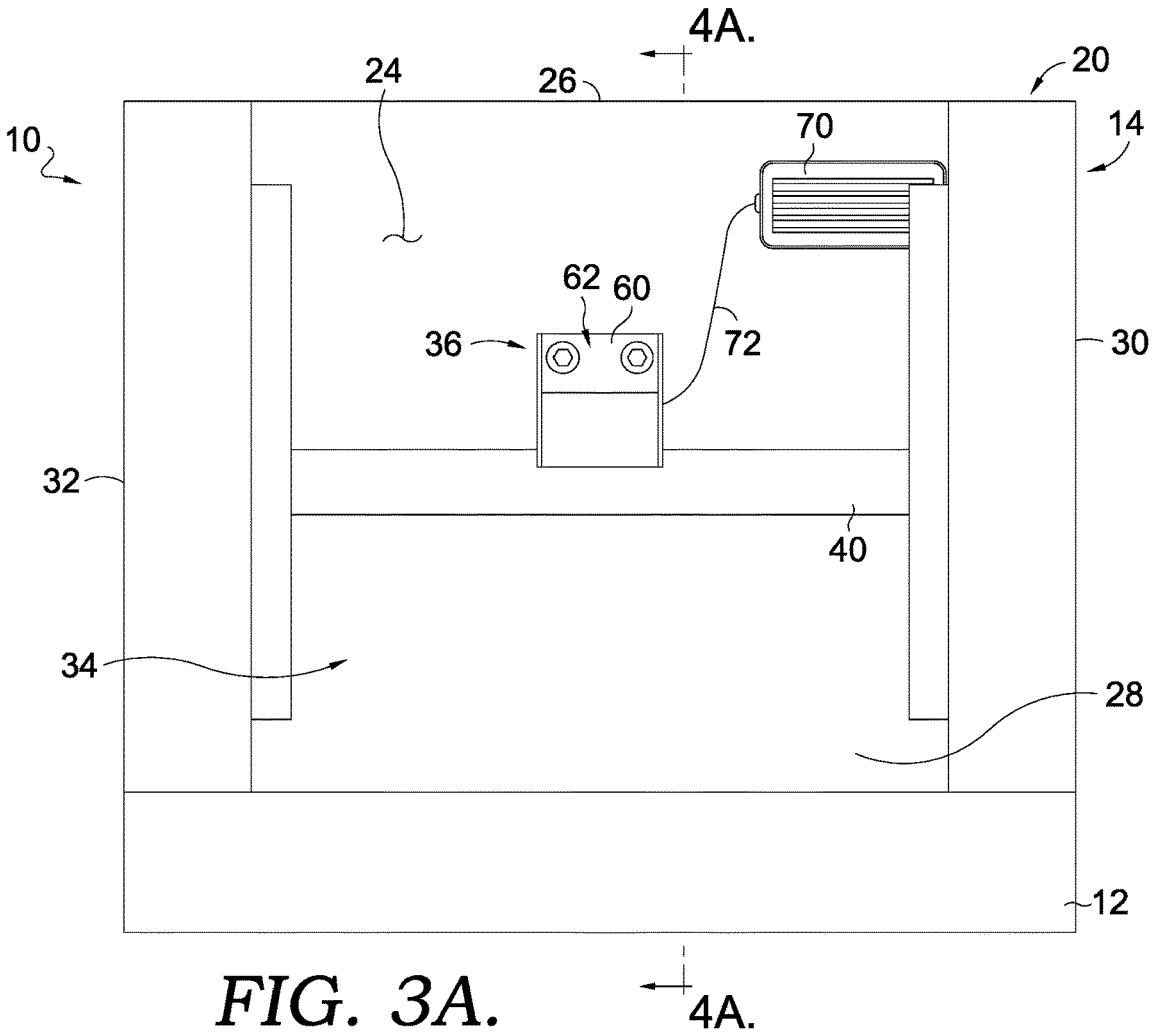
FIG. 3A is a top plan view of the air terminal of FIG. 2.
Figure 3B:
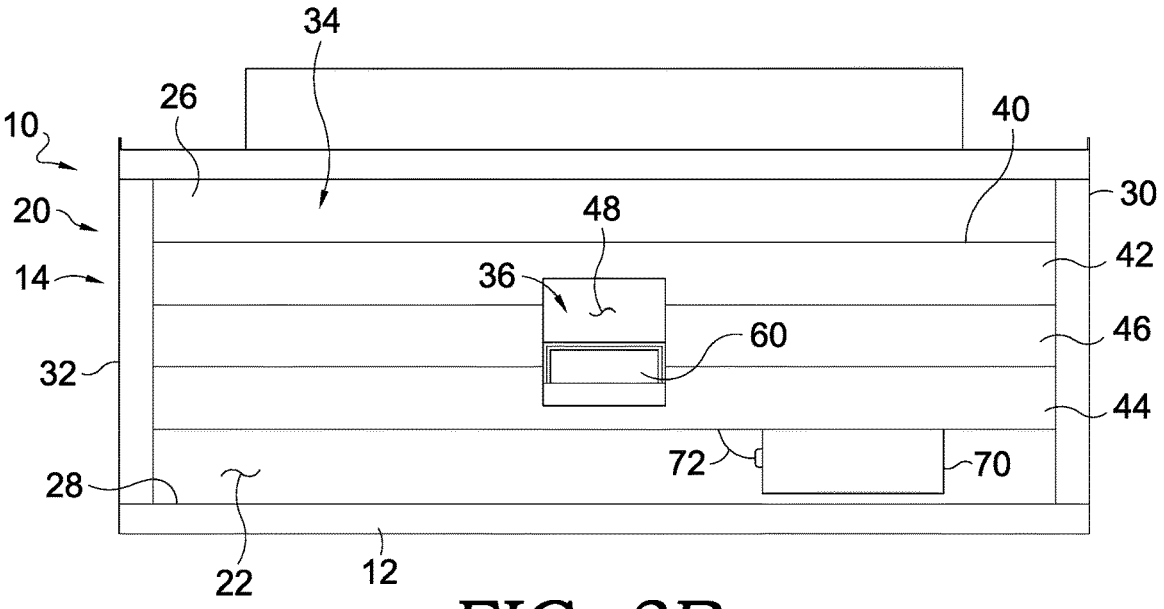
FIG. 3B is a front elevation view of the air terminal of FIG. 2.

Referring now to FIGS. 3A and 3B, the air terminal 10 is again shown without parts of the damper 12 and with the upper diffuser 16 removed to better illustrate aspects of the air delivery assembly 14. As can be seen from these views, the air delivery assembly 14 further includes a power supply 70 that is positioned within the air flow chamber 34 proximate the back and right walls 26, 30 of the chassis 20. The power supply 70 is configured to supply power to the ionizer 60 via a wire 72, and in example aspects, the power supply 70 supplies power to the ionizer 60 at a low voltage (e.g., 24 VAC, 12 VDC). In another example aspect, the power supply 70 may convert power, which may be provided by an external source and then supply the converted power to the ionizer 60 (e.g., convert 24 VAC to 12 VDC and then supply 12 VDC).

Aspects herein contemplate that the power supply 70 may be included in the air delivery assembly 14 in a different manner than depicted in FIGS. 3A-3B. Such aspects contemplate that the power supply 70 may be positioned in the air flow chamber 34 at any suitable location, such as proximate the back and left walls 26, 32. Other aspects herein contemplate that the power supply 70 may be positioned outside of the air flow chamber 34.

Figure 4A:
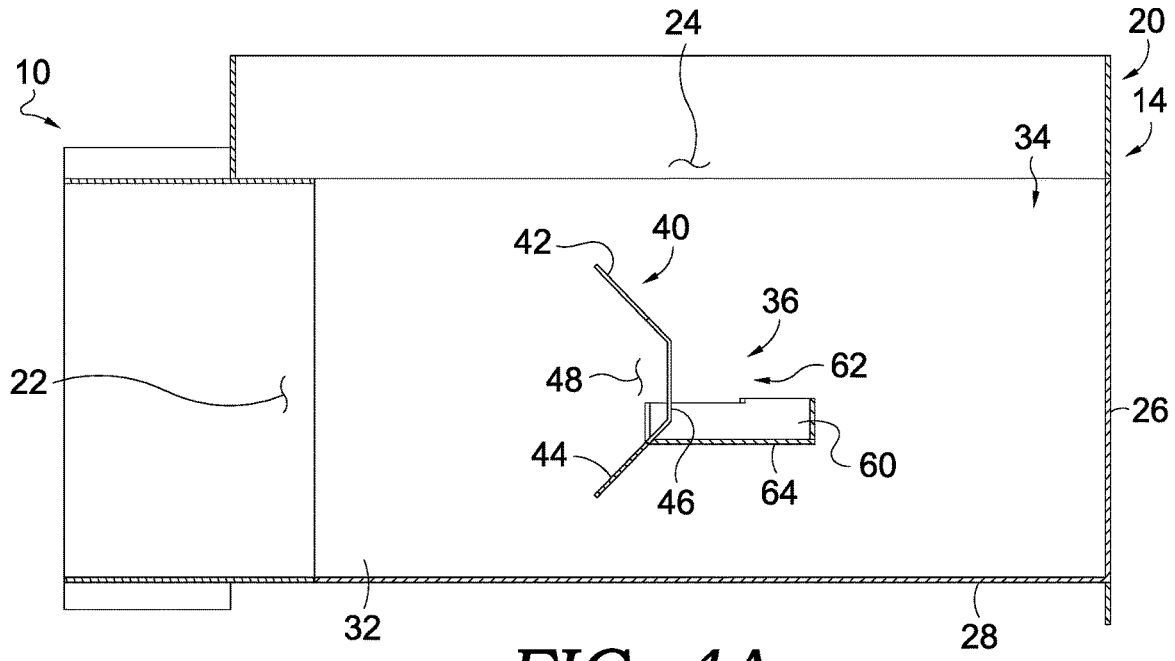
FIG. 4A is a cross-sectional view of the air terminal of FIG. 2 taken along the line 4-4 of FIG. 3A.

Turning now to the baffle 40 and with additional reference to FIGS. 4A and 5, it includes an upper wing 42, a lower wing 44, a medial body 46, a central opening 48, a right flange 52, and a left flange 54. The medial body 46 is positioned between the upper and lower wings 42, 44, each of which extend from an opposite side of the medial body 46. The upper wing 42 angularly extends towards the front opening and top opening 22, 24, while the lower wing 44 angularly extends towards the front opening 22 and the bottom wall 28. Each of the upper wing 42, the lower wing, 44, and the medial body 46 has a generally planar, rectangular shape, and collectively, they form a general structure of the baffle 40. The central opening 48 is generally rectangular, is positioned at a generally centermost location of the baffle 40, and vertically extends throughout the medial body 46 and into a portion of the upper and lower wings 42, 44. In aspects, the baffle may be formed from sheet-metal, galvanized steel or other suitable materials.

The baffle 40 is coupled between the right and left walls 30, 32 of the chassis 20 via the right and left flanges 52, 54 and a coupling means 80, which is generally depicted as bolts and apertures. It should be appreciated by one of ordinary skill in the art that any suitable coupling method may be used. The baffle 40 laterally extends through the air flow chamber 34 in a direction that is generally parallel to the front opening 22 and the back wall 26, and thus, the baffle 40 is oriented in a manner that bifurcates the air flow chamber 34 into a front portion (between the front opening 22 and the baffle 40) and a back portion (between the baffle 40 and the back wall 26). Moreover, as best shown in FIG. 3B, the baffle 40 is vertically positioned in the chassis 20 such that the upper wing 42 is spaced apart from the top opening 24 and similarly, the lower wing 44 is spaced apart from the bottom wall 28.

Turning now to the ionizer 60 and as shown in FIG. 4A, the ionizer 60 is positioned in a retention device 64, which is configured to retain the ionizer 60 in the air flow chamber 34. The retention device 64 is coupled with the baffle 40 proximate the central opening 48 and forms a shelf directly behind the baffle 60. Aspects herein contemplate that the retention device 64 may be comprised by the baffle 40. For example, the baffle 40 may be constructed to include the retention device 64, which may extend from a bottom portion of the central opening 48. In other aspects, the retention device 64 may be a separate component in which the retention device 64 is coupled, attached, and/or mounted to the baffle 40. It should be appreciated by one of ordinary skill in the art that any suitable coupling, attaching, and/or mounting method may be used.

In example aspects herein, the ionizer 60 is configured to generate ions. Accordingly, the ionizer 60 includes an upper face 62 from which an electrical charge is emanated and imparted to atoms or molecules such that ions 100 are generated at an ionization zone 36. Aspects herein contemplate that the ionization zone 36 refers to a general location at which ions 100 are generated by the ionizer 60. Further aspects contemplate that the ionization zone 36 is relative to a position and/or location of the ionizer 60 and more specifically, the upper face 62 of the ionizer 60. For instance, if the ionizer 60 were moved to a position in the air flow chamber 34 where the upper face 62 is closer to the back wall 26, then the ionization zone 36 would also move in the air flow chamber 34 in a corresponding manner (i.e., closer to the back wall 26). As shown in FIGS. 3A-4B, the ionizer 60 and the upper face 62 are positioned in the air flow chamber 34 such that the ionization zone 36 is located directly behind the baffle 40 and is in alignment with the central opening 48.

Figure 4B:
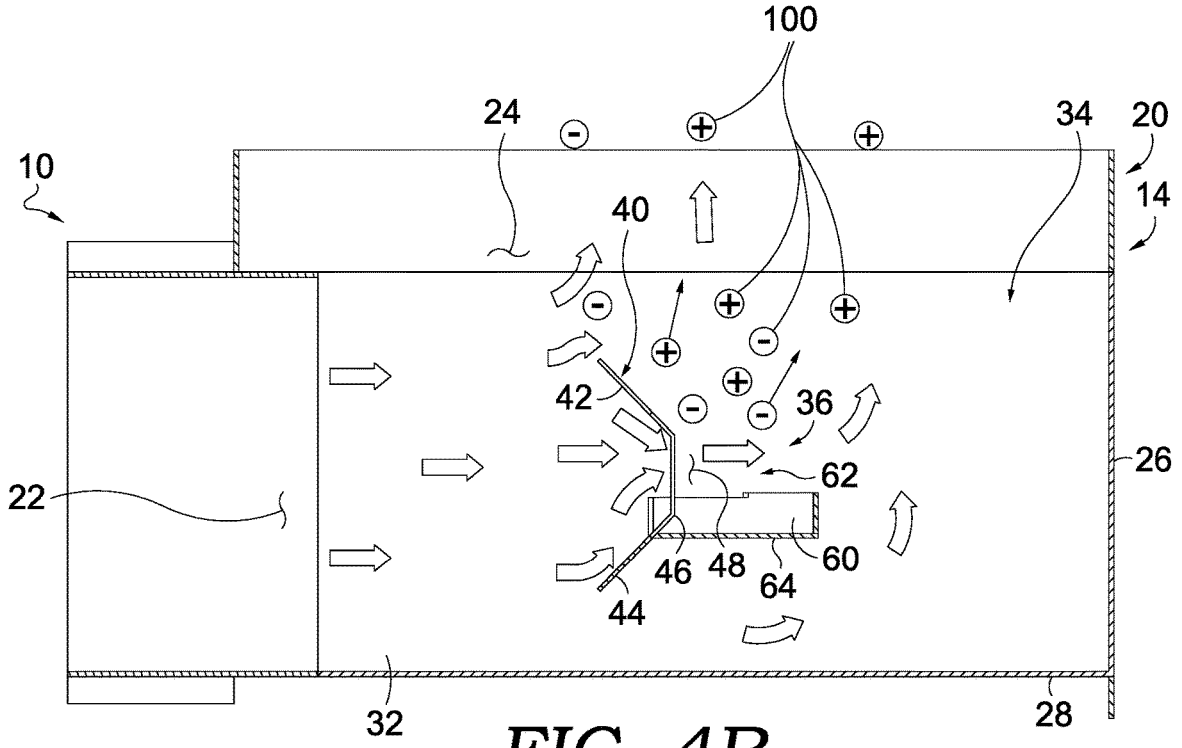
FIG. 4B is the cross-sectional view of the air terminal of FIG. 4A illustratively depicting air flow through the air terminal and a delivery of ions out of the air terminal and into the room there above.

FIG. 4B is a same view of the air delivery assembly 14 as FIG. 4A, but illustratively depicts air flowing therethrough while the ions 100 are being generated by the ionizer 60. Like in FIG. 1, large arrows illustratively depict air flow, and small arrows depict movement of the ions 100. As shown, air enters the air delivery assembly 14 at the lateral opening 22 and then flows into the air flow chamber 34 towards the baffle 40. Once the air reaches the baffle 40, the flow of air is affected such that some of the air will flow through the central opening 48, while any remaining air will flow upward, downward, and/or around the baffle 40. Regarding the air that flows through the central opening 48, as the air flows into the baffle 40, its air velocity increases and/or it is redirected to flow directly to the ionization zone 36, which, at least in part, is due to an orientation of the upper and lower wings 42, 44 relative to a direction at which air flows into the baffle 40. Here, the upper and lower wings 42, 44 are oriented such that the air is funneled to flow through the ionization zone 36 at an air velocity that is greater than or equal to about 150 cubic feet per minute. As a result, the ions 100 are dispersed at the ionization zone 36, moved upwards through the top opening 24, and then delivered to a room. With respect to the remaining air that does not flow through the central opening 48, the baffle 40 is configured such that a flow of this air cooperates with the air flowing through the central opening 48 of the baffle 40 such that a collective flow of air through the top opening 24 is generally balanced, which is suitable for the ions 100 to be delivered through the upper diffuser 16 and into a room.

FIG. 5 depicts an exploded view of the air terminal 10, which is shown with portions of the upper diffuser 16 removed. Aspects relating to the damper 12 and the upper diffuser 16 are discussed hereinafter, and it is it to be understood that the air terminal 10 may include any aspects or combinations thereof that relate to and/or are applicable to the damper 12 and/or the grate assembly 118 disclosed in U.S. Patent Application Publication No. 2007/0066213 A1 and U.S. Pat. No. 9,127,854 B2.

The damper 12 includes a frame 90 and a vane 96. The frame 90 includes a top side 91, a bottom side 92, a left side 94, and a housing 93. The top, bottom, and left sides 91, 92, 94 of the frame 90 are integrally connected. However, it should be appreciated by one of ordinary skill in the art that the top, bottom, and left sides 91, 92, 94 may be separate pieces attached together by any suitable means. Moreover, the top, bottom, and left sides 91, 92, 94 may each include one or more lips, flanges, and/or tabs, any of which may include one or more apertures, that are configured to respectively couple the top, bottom, and left sides 91, 92, 94 to one another, other components of damper 12, and/or other components of the air terminal 10 (e.g., the air delivery assembly 14, the upper diffuser 16). It should be appreciated by one of ordinary skill in the art that any suitable coupling method may be used.

The housing 93 contains a cover 95 and houses a motor (not shown), which is configured to move the vane 96. The motor, along with the damper 12, and the vane 96 are disclosed in U.S. Patent Application Publication No. 2007/0066213 A1, which, again, is hereby incorporated by reference. As discussed therein, a control system for the damper receives input signals from a thermostat or other sensor in the room. Based on the signals received, the control system provides control signals to the motor which operates the damper 12. The control system may provide an "open signal or a "close signal to the motor. When an open signal is provided, the motor is activated to rotate the vane 96 of the damper 12 to the open position, and the damper 12 remains in that position until a close signal is provided, wherein, the motor rotates the vane 96 of the damper 12 to the closed position. The control of the damper 12 involves assigning the damper 12 a duty cycle having a fairly short duration, normally under two minutes and often amounting only to seconds. During each duty cycle, the damper 12 is maintained open (or "on") for a time period that is dependent upon a set point temperature and the actual temperature in the room or space. During the remainder of each duty cycle, the damper 12 is maintained closed (or "off"). The duration of each "open" or "on" time period is adjusted in order to maintain the set point temperature.

Returning to FIG. 5, the upper diffuser 16 (not shown) may include a mounting portion 38 that is configured to receive one or more plates of the upper diffuser 16 and is also configured to couple the upper diffuser 16 to the air delivery assembly 14 via a coupling means 82, which is generally depicted as bolts and apertures. It should be appreciated by one of ordinary skill in the art that any suitable coupling method may be used. The mounting portion 38 is further configured to mount the air delivery assembly 14 within a hole in the floor 4.

Aspects herein contemplate that the damper 12, the air delivery assembly 14, and the upper diffuser 16 may include different configurations and may be combined in different manners than depicted in FIGS. 1-5. For example, the upper diffuser 16 may comprise circular or rounded components such as one or more circular plates and/or grillees. As such, the mounting portion 38 may also be configured to receive the one or more circular plates and/or grillees, while also being configured to couple the upper diffuser 16 with the air delivery assembly 14.

Figure 6:
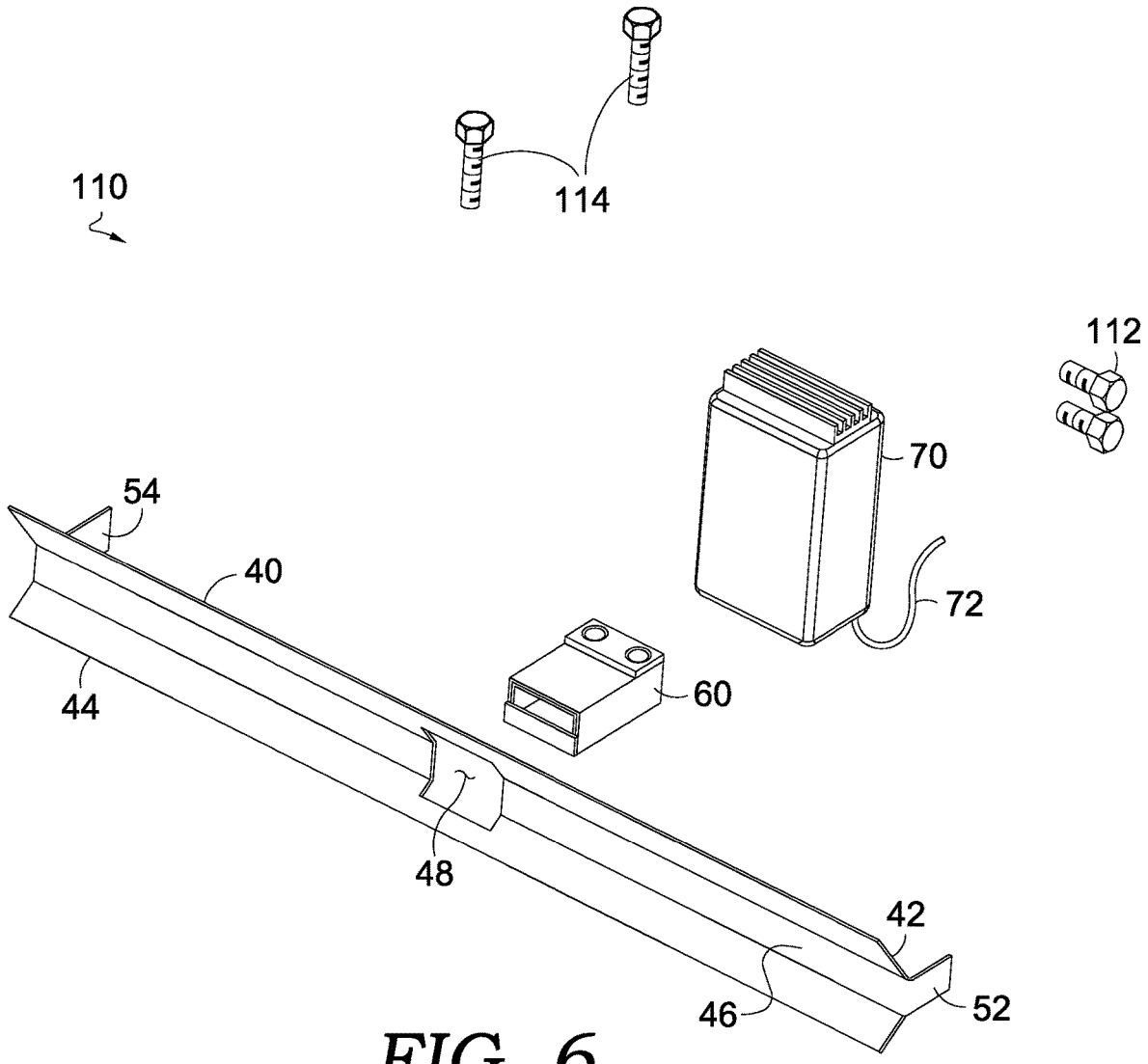

FIG. 6 depicts an ion delivery kit 110 for retrofitting an air terminal of the prior art for ion delivery. The ion delivery kit 110 includes the baffle 40, the ionizer 60, the power supply 70, a first coupling means 112, and a second coupling means 114. The baffle 40, the ionizer 60, and the power supply 70 have the same features as discussed above. For example, the baffle 40 includes the upper wing 42, the lower wing 44, the medial body 46, the right flange 52, and the left flange 54. The first and second coupling means 112, 114 are configured to couple the baffle 40, the ionizer 60, and/or the power supply 70 to a prior art air terminal to retrofit the same. While the first and second coupling means 112, 114 are generically depicted as bolts, it should be appreciated by one of ordinary skill in the art that any suitable coupling method may be used. In one example aspect, the first and/or second coupling means 112, 114 may be the retention device 64 and thus, may be used to position the ionizer 60 directly rearward of the baffle 40 such that the ionization zone 36 is aligned with the central opening 48. In addition, it should further be understood by one of ordinary skill in the art that one or more of the baffle 40, the ionizer 60, and/or the power supply 70 may be modified as needed to be suitable for a particular retrofitting. For example, the baffle 40 may be sized to have a width that is suitable for the baffle 40 to be coupled between a pair of sidewalls of an air delivery assembly that is to be retrofitted with the ion delivery kit 110.

Figure 7:
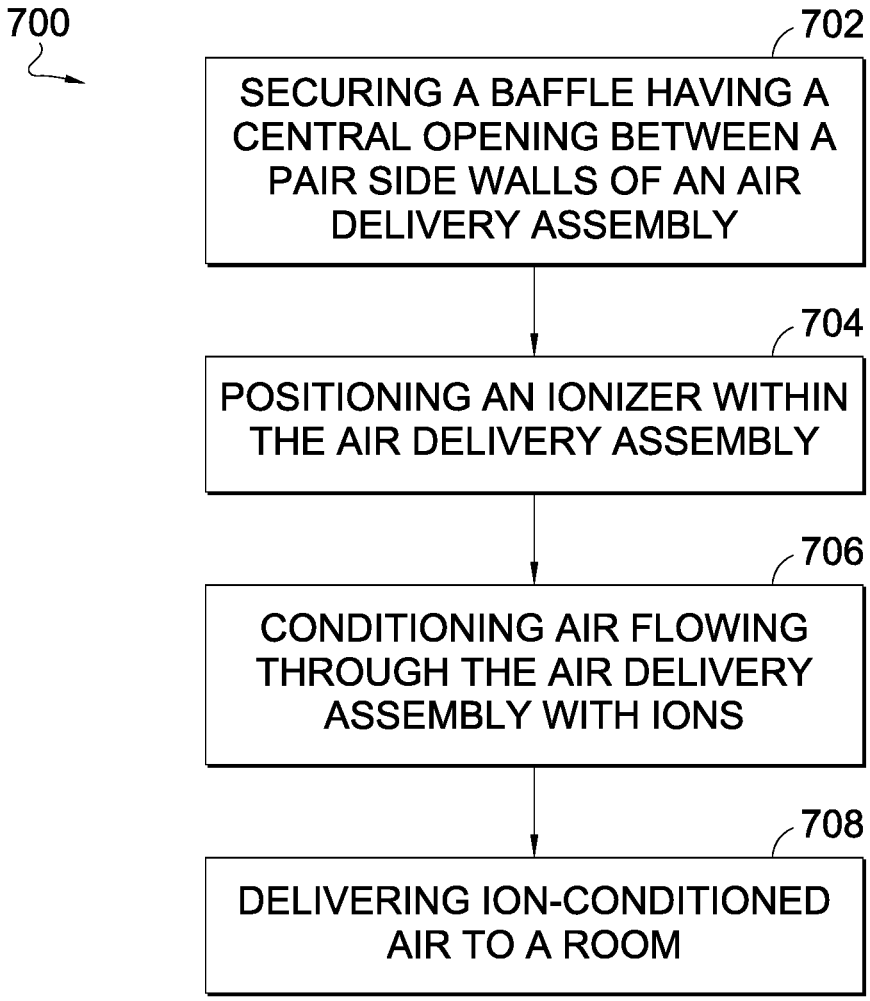

FIG. 7 illustrates a flow diagram of an example method 700 of supplying ions to a room 2. As shown, at block 702, a first step of the method 700 is depicted, which is securing a baffle having a central opening, such as the baffle 40 between a pair of sidewalls of an air delivery assembly, such as the right and left walls 30, 32 of the air delivery assembly 14. At block 704, a second step of the method 700 is depicted, which includes positioning an ionizer, such as the ionizer 60, within the air delivery assembly, such as the air delivery assembly 14. In aspects, the ionizer may be positioned in a same manner as the ionizer 60 in which the ionization zone 36 is aligned with the central opening 48 of the baffle 40. Aspects herein contemplate that the first and second steps relate to retrofitting a prior art floor terminal for ion delivery and may be omitted from the method 700 or may be optionally performed if retrofitting is not needed and/or has previously occurred.

Block 706 depicts a third step of the method 700 and includes conditioning air flowing through the air delivery assembly with ions, which may be performed when air is supplied through a lateral opening of an air delivery assembly, such as the air delivery assembly 14, and then flows therethrough in a same or similar manner as discussed in connection with FIG. 4B. At block 708, a fourth step 708 of the method 700 is depicted, which includes delivering ion-conditioned air to a room and may be performed when air flows through a top opening of an air delivery assembly, such as the air delivery assembly 14 and in a same or similar manner as discussed in connection with FIG. 4B.

Accordingly, the present invention discloses an air delivery assembly with an ionizer and a baffle construction that affects air flow through an air flow chamber of the air delivery assembly in a manner that is suitable for a delivery of ions into a room. The air delivery assembly may be included as part of an air terminal in a raised floor air distribution system. Many variations can be made to the illustrated embodiment of the present invention without departing from the scope of the present invention. Such modifications are within the scope of the present invention. For example, the damper could be removed from the air terminal or be incorporated into the upper diffuser. Moreover, the upper diffuser and/or plates or grillees thereof could be replaced with a diffuser grillee having additional vented openings or a different configuration of openings on the diffuser grillee (and corresponding damper valve plates) to provide various air flow patterns. Other modifications would be within the scope of the present invention.

From the foregoing it will be seen that this invention is one well adapted to attain all ends and objects hereinabove set forth together with the other advantages which are obvious and which are inherent to the method and apparatus. It will be understood that certain features and subcombinations are of utility and may be employed without reference to other features and subcombinations. This is contemplated by and is within the scope of the invention.

Since many possible embodiments may be made of the invention without departing from the scope thereof, it is to be understood that all matter herein set forth or shown in the accompanying drawings is to be interpreted as illustrative of applications of the principles of this invention, and not in a limiting sense.

What is claimed is:

1. An air delivery assembly for delivering ions, the air delivery assembly comprising:

a raised floor air distribution system, comprising:

a chassis comprising a lateral opening, a top opening, a back wall, a bottom wall, and a pair of sidewalls, wherein the lateral opening is opposite the back wall, wherein the top opening is opposite the bottom wall, wherein the pair of sidewalls are spaced apart and generally face one another, and wherein the back wall, the bottom wall, and the pair of sidewalls cooperate to define an air flow chamber;

a baffle coupled between the pair of sidewalls of the chassis, wherein the baffle comprises a central opening; and an ionizer configured to generate ions at an ionization zone, wherein the ionizer is positioned in the air flow chamber such that the ionization zone is aligned with the central opening of the baffle.

2. The air delivery assembly of claim 1, wherein the baffle further comprises an upper wing, a lower wing, and a medial body, wherein the upper and lower wings each extend away from opposite sides of the medial body and towards the lateral opening of the chassis.

3. The air delivery assembly of claim 1 further comprising a power supply positioned in the air flow chamber and configured to supply power to the ionizer.

4. The air delivery assembly of claim 3, wherein the power supply is further configured to supply power to the ionizer at a low voltage.

5. The air delivery assembly of claim 1 further comprising a retention device configured to maintain a position of the ionizer in the air flow chamber.

6. The air delivery assembly of claim 5, wherein the retention device is coupled to the baffle proximate the central opening.

7. An air terminal for delivering ions into a room having a raised floor air distribution system, the air terminal comprising:

an air delivery assembly comprising a baffle and an ionizer, wherein the baffle includes a central opening and the ionizer is configured to generate ions at an ionization zone aligned with the central opening;

a damper coupled to a lateral opening of the air delivery assembly; and an upper diffuser coupled to a top opening of the air deliver assembly.

8. The air terminal of claim 7, wherein the baffle comprises an upper wing, a lower wing, and a medial body, wherein the upper and lower wings each extend away from opposite sides of the medial body and towards the lateral opening.

9. The air terminal of claim 7, wherein the air delivery assembly further comprises a power supply configured to supply power to the ionizer at a low voltage.

10. The air terminal of claim 7, wherein the air delivery assembly further comprises a retention device configured to maintain a position of the ionizer, wherein the retention device is coupled to the baffle proximate the central opening.

11. The air terminal of claim 7, wherein the air delivery assembly further comprises a chassis having a pair of sidewalls, wherein the pair of sidewalls are perpendicular to the front opening, and wherein the baffle is coupled between the pair of sidewalls.

12. The air terminal of claim 7, wherein the damper has a frame with a housing and a vane coupled between the frame and the housing.

13. The air terminal of claim 7, wherein the upper diffuser has a mounting portion configured to mount the air delivery assembly within a hole of a floor.

14. A method for delivering ions to a room having a space located below a floor underlying the room, the method comprising:

enclosing an area under the floor to create a supply plenum;

providing an air terminal having an air delivery assembly, the air delivery assembly including a baffle with a central opening and an ionizer configured to generate ions at an ionization zone aligned with the central opening of the baffle; and supplying air into the supply plenum for delivery to the room above the air terminal through the air delivery assembly, wherein the baffle of the air delivery assembly affects air flow such that at least some air flowing through the air delivery assembly delivers ions to the room.

15. The method of claim 14, wherein the baffle comprises an upper wing, a lower wing, and a medial body, wherein the upper and lower wings each extend away from opposite sides of the medial body and towards a lateral opening of the air delivery assembly.

16. The method of claim 14, wherein the air delivery assembly further comprises a power supply configured to supply power to the ionizer at a low voltage.

17. The method of claim 14, wherein the air terminal comprises an upper diffuser coupled to a top opening of the air delivery assembly.

18. The method of claim 14, wherein the air terminal comprises a damper coupled to a lateral opening of the air delivery assembly.

19. A kit for retrofitting an air delivery assembly of a raised floor air distribution system for a delivery of ions into a room, the kit comprising:

a baffle comprising a central opening;

an ionizer configured to generate ions at an ionization zone; and a coupling means configured to couple the baffle with the air delivery assembly, whereby the ionizer is aligned with the central opening of the baffle such that the ionization zone is adjacent the central opening.

20. A method of retrofitting an air delivery assembly of a raised floor air distribution system for a delivery of ions to a room, the method comprising:

securing a baffle between a pair of sidewalls of the air delivery assembly, wherein the baffle comprises a central opening; and positioning an ionizer within the air delivery assembly, wherein the ionizer is configured to generate ions at an ionization zone, and wherein the ionization zone is aligned with the central opening of the baffle.

* * * * *